US010287798B2

(12) United States Patent
Huang et al.

(10) Patent No.: US 10,287,798 B2
(45) Date of Patent: May 14, 2019

(54) ELECTRIC LOCK AND CLUTCH MECHANISM THEREOF

(71) Applicant: TAIWAN FU HSING INDUSTRIAL CO., LTD., Kaohsiung (TW)

(72) Inventors: Lien-Hsi Huang, Kaohsiung (TW); Wen-Chieh Lee, Kaohsiung (TW)

(73) Assignee: TAIWAN FU HSING INDUSTRIAL CO., LTD., Kaohsiung (TW)

( * ) Notice: Subject to any disclaimer, the term of this patent is extended or adjusted under 35 U.S.C. 154(b) by 71 days.

(21) Appl. No.: 15/594,679

(22) Filed: May 15, 2017

(65) Prior Publication Data

US 2018/0135335 A1 May 17, 2018

(30) Foreign Application Priority Data

Nov. 14, 2016 (TW) ..... 105136984 A

(51) Int. Cl.
*E05B 13/00* (2006.01)
*E05B 17/04* (2006.01)
(Continued)

(52) U.S. Cl.
CPC ..... *E05B 17/045* (2013.01); *E05B 13/005* (2013.01); *E05B 13/101* (2013.01);
(Continued)

(58) Field of Classification Search
CPC ..... E05B 13/00; E05B 13/005; E05B 13/101; E05B 17/04; E05B 17/044; E05B 17/045; E05B 17/046; E05B 2047/0026; E05B 2047/0027; E05B 2047/0028; E05B 2047/003
See application file for complete search history.

(56) References Cited

U.S. PATENT DOCUMENTS 5,199,285 A * 4/1993 Lin ..... E05B 13/101 70/190
7,007,526 B2 * 3/2006 Frolov ..... E05B 47/068 70/107
(Continued)

FOREIGN PATENT DOCUMENTS

| | | |
|---|---|---|
| CA | 2 799 338 A1 | 6/2013 |
| CN | 201367795 Y | 12/2009 |
| TW | M297994 | 9/2006 |
| TW | I458882 B | 11/2014 |

*Primary Examiner* — Christopher J Boswell
(74) *Attorney, Agent, or Firm* — Winston Hsu

(57) ABSTRACT

An electric lock includes a base, a driving module, a handle and a clutch member. The driving module is arranged on the base. The driving module includes a driving member rotatable relative to the base, and a motor configured to drive the driving member to rotate. The handle is rotatably mounted to the base, and has a plurality of pushing structures. The clutch member includes a main body having a first end and a second end opposite to the first end, and a pushed structure formed on the first end of the main body. Wherein, when the motor drives the driving member to rotate in order to abut against the main body at a first position, the first end of the main body is tilted toward the handle, such that the pushing structure abuts against the pushed structure for pushing the clutch member to rotate when the handle is rotated.

16 Claims, 10 Drawing Sheets

(51) Int. Cl.

| | |
|---|---|
| ***E05B 47/00*** | (2006.01) |
| ***E05B 13/10*** | (2006.01) |
| ***E05B 49/00*** | (2006.01) |
| ***E05B 47/06*** | (2006.01) |
| *E05B 1/00* | (2006.01) |

(52) U.S. Cl.
CPC ..... *E05B 47/0012* (2013.01); *E05B 47/0676* (2013.01); *E05B 49/00* (2013.01); *E05B 1/003* (2013.01); *E05B 2047/002* (2013.01); *E05B 2047/0026* (2013.01); *E05B 2047/0028* (2013.01); *E05B 2047/0086* (2013.01)

(56) References Cited

U.S. PATENT DOCUMENTS

| | | | | |
|---|---|---|---|---|
| 7,231,791 | B2 * | 6/2007 | Sakai | E05B 47/0012 70/277 |
| 7,770,423 | B2 * | 8/2010 | Wu | E05B 47/0012 292/142 |
| 7,827,837 | B2 | 11/2010 | Huang | |
| 7,963,134 | B2 * | 6/2011 | Rafferty | E05B 13/00 192/69.8 |
| 8,621,900 | B2 * | 1/2014 | Wu | E05B 47/026 292/142 |
| 9,051,762 | B2 * | 6/2015 | Huang | E05B 47/0012 |
| 9,435,143 | B2 | 9/2016 | Shen | |
| 2008/0196457 | A1 * | 8/2008 | Goldman | E05B 13/103 70/224 |

* cited by examiner

ELECTRIC LOCK AND CLUTCH MECHANISM THEREOF

BACKGROUND OF THE INVENTION

1. Field of the Invention

The present invention relates to an electric lock, and more particularly, to an electric lock having a clutch mechanism which is simple and easy to assemble.

2. Description of the Prior Art

Generally, an electric lock utilizes a gear transmission mechanism to transmit a torsion torque outputted by a motor, so as to drive a clutch mechanism of the electric lock to engage with or disengage from a latch assembly. When the gear transmission mechanism is forwardly driven by the motor, a pushed structure on the gear transmission mechanism can drive the clutch mechanism to engage with the latch assembly of the electric lock. Accordingly, a torsion torque exerted by a handle can be transmitted to the latch assembly, so that a user can open the door by rotating the handle. When the gear transmission mechanism is reversely driven by the motor, a spring can drive the clutch mechanism to disengage from the latch assembly of the electric lock. Thus, the torsion torque exerted by the handle cannot be transmitted to the latch assembly, so that the latch assembly can keep in a locked status. However, the clutch mechanism and the gear transmission mechanism have complex structures and are not easy to assemble. Therefore, the electric lock of the prior art has higher production cost and lower production efficiency.

SUMMARY OF THE INVENTION

The present invention provides an electric lock comprising a base, a driving module, a handle and a clutch member. The driving module is arranged on the base. The driving module includes a driving member rotatable relative to the base, and a motor configured to drive the driving member to rotate. The handle is rotatably mounted to the base, and has a plurality of pushing structures. The clutch member includes a main body having a first end and a second end opposite to the first end, and a pushed structure formed on the first end of the main body. Wherein when the motor drives the driving member to rotate in order to abut against the main body at a first position, the first end of the main body is tilted toward the handle, such that the pushing structure is configured to abut against the pushed structure for pushing the clutch member to rotate when the handle is rotated.

The present invention further provides a clutch mechanism comprising a clutch member and a driving module. The clutch member comprises a main body and a pushed structure. The main body has a first end and a second end opposite to the first end and the pushed structure is formed on the first end of the main body. The driving module is configured to abut against the main body of the clutch member and is rotatable relative to the main body. Wherein when the driving module abuts against the main body at a first position, the first end of the main body is tilted away from the driving module and the second end of the main body is tilted toward the driving module.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
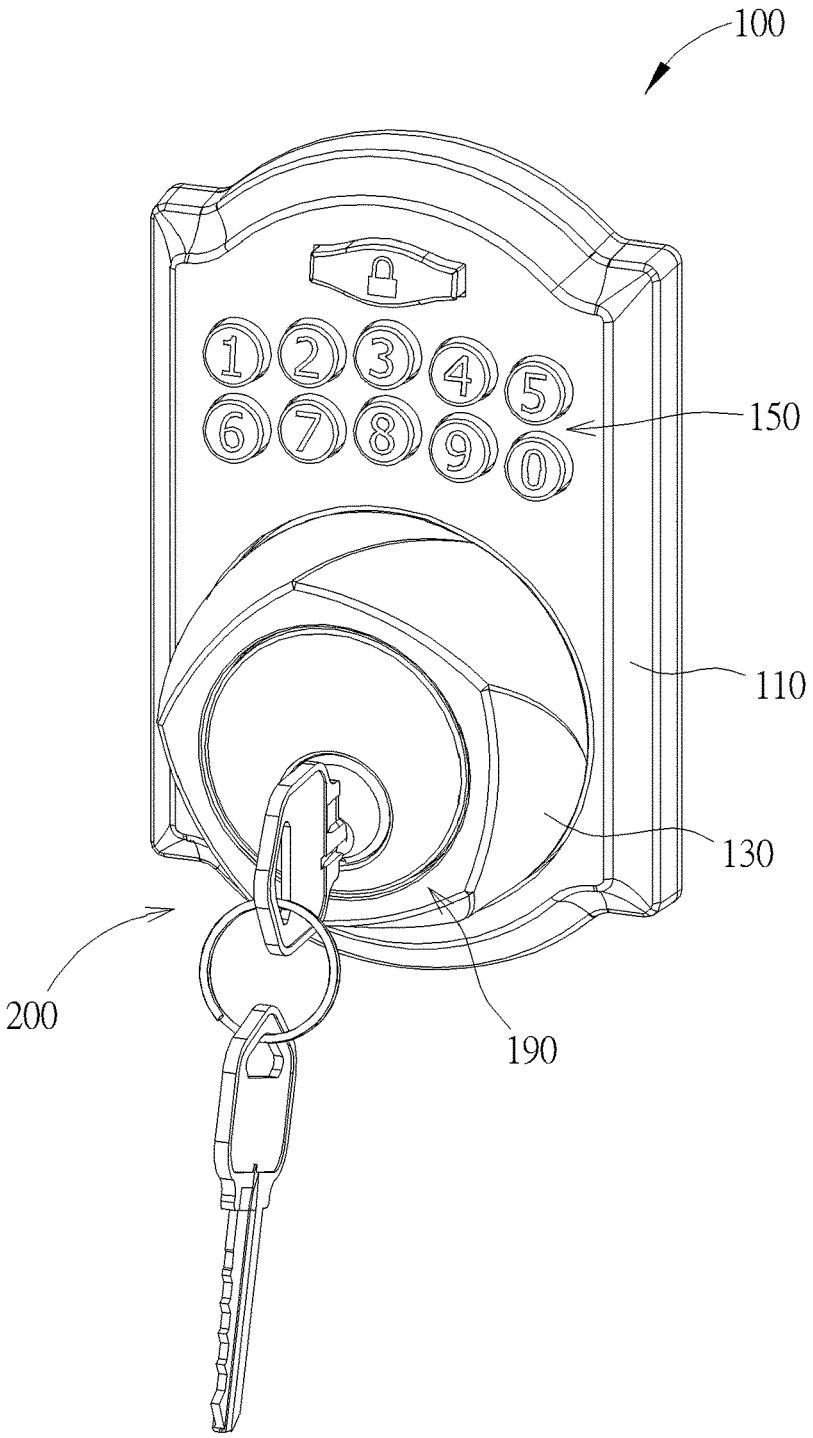
FIG. 1 is a diagram showing an electric lock of the present invention.
Figure 2:
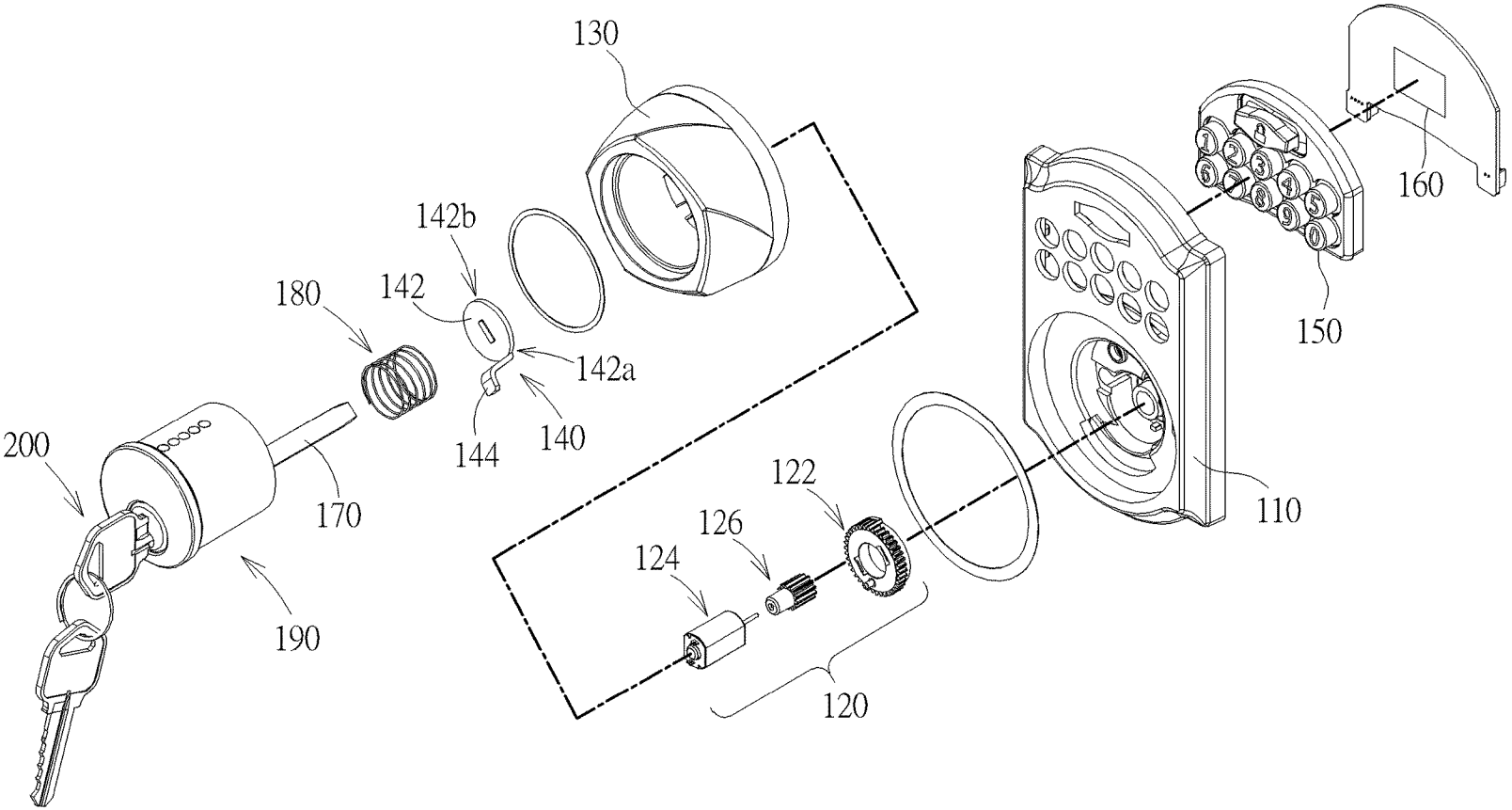
FIG. 2 is an exploded view of the electric lock of the present invention.

Please refer to FIG. 1 and FIG. 2 together. FIG. 1 is a diagram showing an electric lock of the present invention. FIG. 2 is an exploded view of the electric lock of the present invention. As shown in figures, the electric lock 100 of the present invention comprises a base 110, a driving module 120, a handle 130, a clutch member 140, an input interface 150 and a control unit 160. The electric lock 100 of the present invention can be fixed to a door for controlling movement of a latch on the door. The driving module 120 is arranged on the base 110. The driving module 120 comprises a driving member 122, a motor 124 and a transmission member 126. The driving member 122 is rotatable relative to the base 110. The transmission member 126 is connected between the motor 124 and the driving member 122 for transmitting power of the motor 124 to the driving member 122 in order to drive the driving member 122 to rotate. The handle 130 is installed on the base 110 in a rotatable manner. The clutch member 140 comprises a main body 142 and a pushed structure 144. The main body 142 has a first end 142*a* and a second end 142*b* opposite to the first end 142*a*. The pushed structure 144 is formed on the first end 142*a* of the main body 142. The input interface 150 is configured to receive a set of input data. In the present embodiment, the input interface 150 is a numeric keyboard for receiving a password inputted by a user, but the present invention is not limited thereto. In other embodiments of the present invention, the input interface can be a touch panel or other type of input device. A control unit 160 is electrically connected to the input interface 150 and the motor 124 for controlling the motor 124 to rotate when the set of input data matches a set of predetermined data. For example, when the password entered by the user matches a predetermined password, the control unit 160 can control the motor 124 to rotate, in order to further drive related components of the electric lock 100 for controlling the electric lock 100 to be in an unlocked state (or a locked state).

In addition, the electric lock 100 of the present invention further comprises a transmission rod 170 configured to be connected to a latch (not shown in the figures). When the transmission rod 170 is rotated, the transmission rod 170 is configured to drive the latch to move between an unlocked position and a locked position. The clutch member 140 is sleeved on the transmission rod 170. When the clutch member 140 is rotated, the clutch member 140 is configured to drive the transmission rod 170 to rotate, in order to further drive the latch to move. Moreover, the electric lock of the present invention further comprises an elastic member 180 configured to push the main body 142 of the clutch member 140 away from the handle 130.

On the other hand, the electric lock of the present invention further comprises a lock core 190 connected to the transmission rod 170. When the lock core 190 is driven by a key 200, the lock core 190 is configured to drive the transmission rod 170 to rotate, in order to further drive the latch to move. As such, when the electric lock 100 of the present invention loses power, the user can still use the key to perform unlocking or locking operation.

Figure 3:
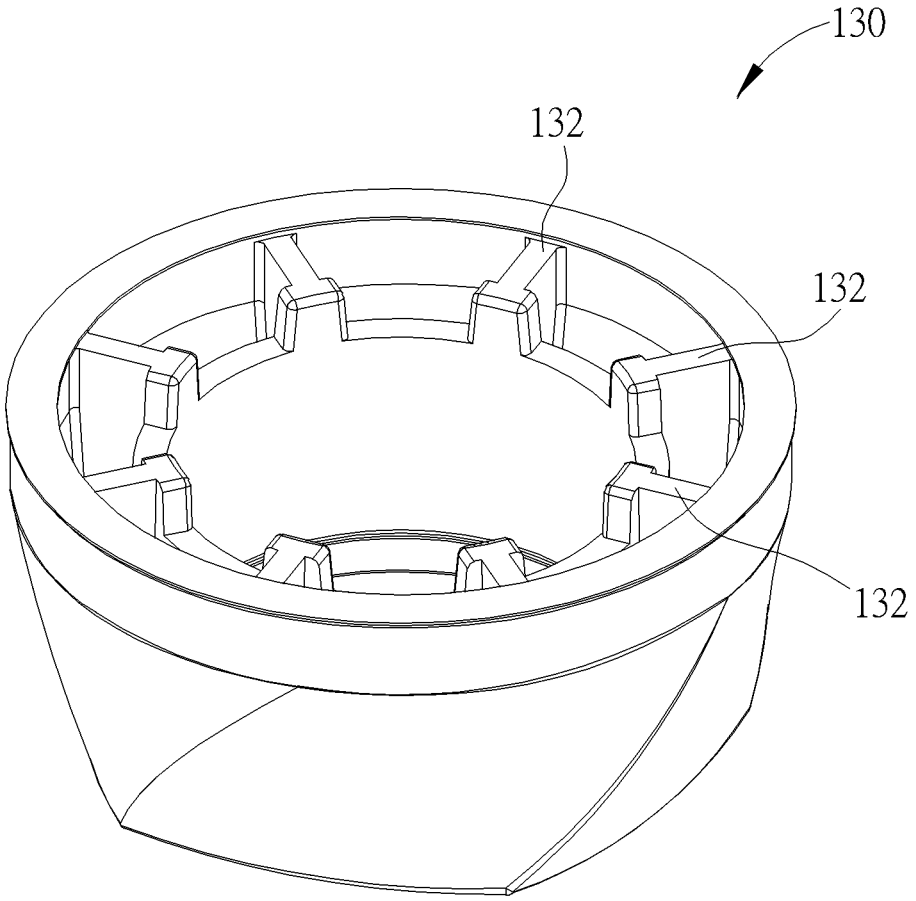
FIG. 3 is a diagram showing a handle of the electric lock of the present invention.

Please refer to FIG. 3. FIG. 3 is a diagram showing the handle of the electric lock of the present invention. As shown in FIG. 3, an inner periphery of the handle 130 of the present invention is formed with a plurality of pushing structures 132. In the present embodiment, the pushing structures 132 are protruded ribs, and a groove is formed between every two pushing structures 132. When the pushing structure 132 abuts against the pushed structure 144 of the clutch member 140, the handle 130 can be rotated for pushing the clutch member 140 to rotate.

Figure 4:
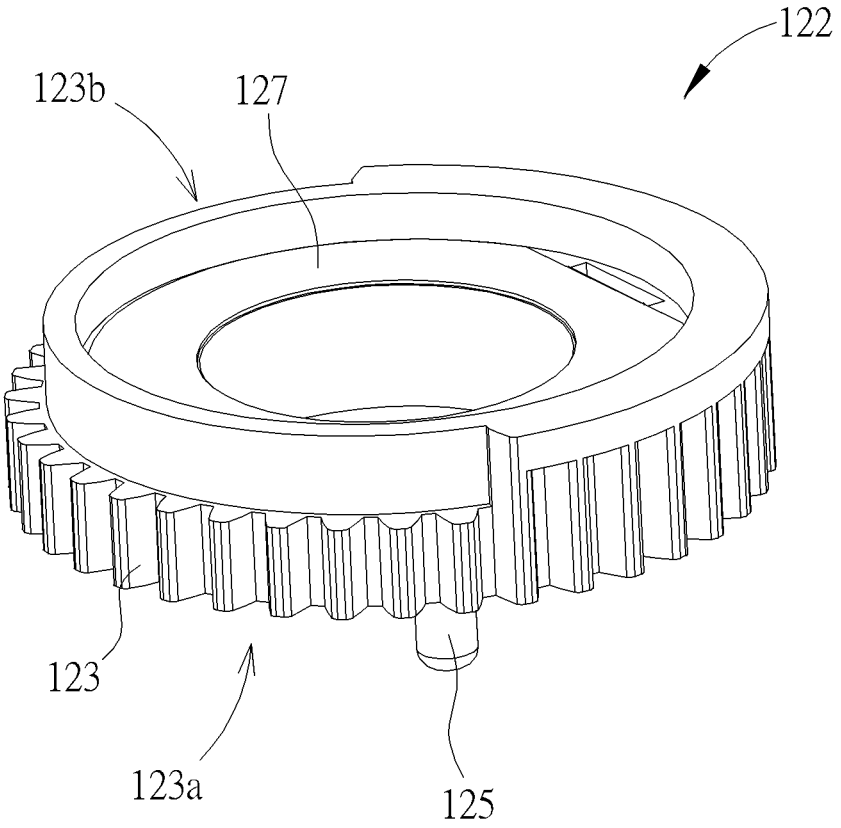
FIG. 4 is a diagram showing a driving member of the electric lock of the present invention.
Figure 5:
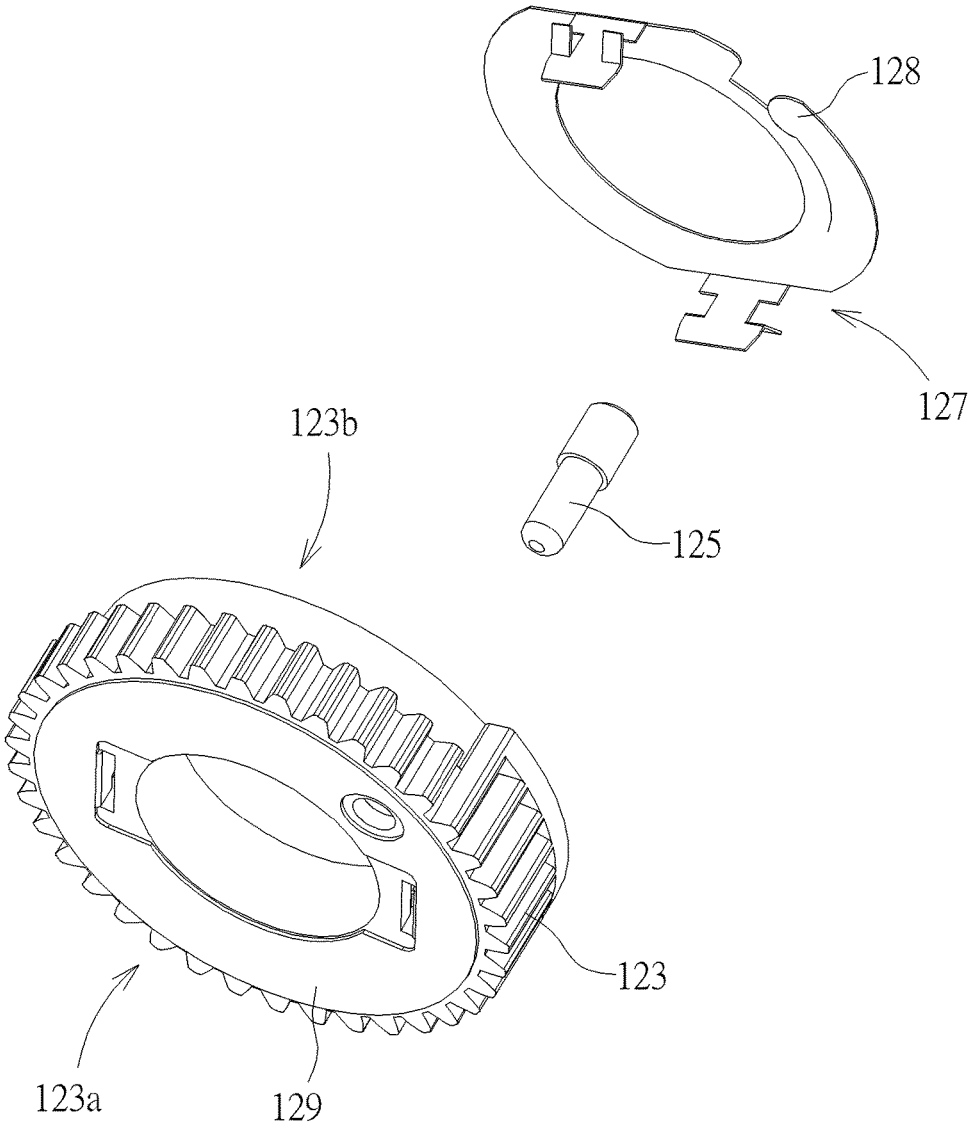
FIG. 5 is an exploded view of the driving member of the electric lock of the present invention.

Please refer to FIG. 4 and FIG. 5 together. FIG. 4 is a diagram showing the driving member of the electric lock of the present invention. FIG. 5 is an exploded view of the driving member of the electric lock of the present invention. As shown in figures, the driving member 122 of the present invention comprises a gear 123, a pin 125 and an elastic piece 127. The gear 123 is configured to be engaged with the transmission member 126, in order to allow the motor 124 to drive the gear 123 to rotate. The pin 125 penetrates through the gear 123 to protrude from a first side 123*a* of the gear 123. The pin 125 is configured to abut against the main body 142 of the clutch member 140, in order to tilt the main body 142 of the clutch member 140. The elastic piece 127 is arranged at a second side 123*b* of the gear 123, and the pin 125 is connected to an elastic arm 128 of the elastic piece 127. When an external force is applied to the pin 125 and the external force is greater than an elastic force of the elastic arm 128, the pin 125 is retracted toward the second side 123*b* of the gear 123. In addition, the driving member 122 of the present invention further comprises a pad 129 arranged on the first side 123*a* of the gear 123 for preventing abrasion of the gear 123.

Figure 6:
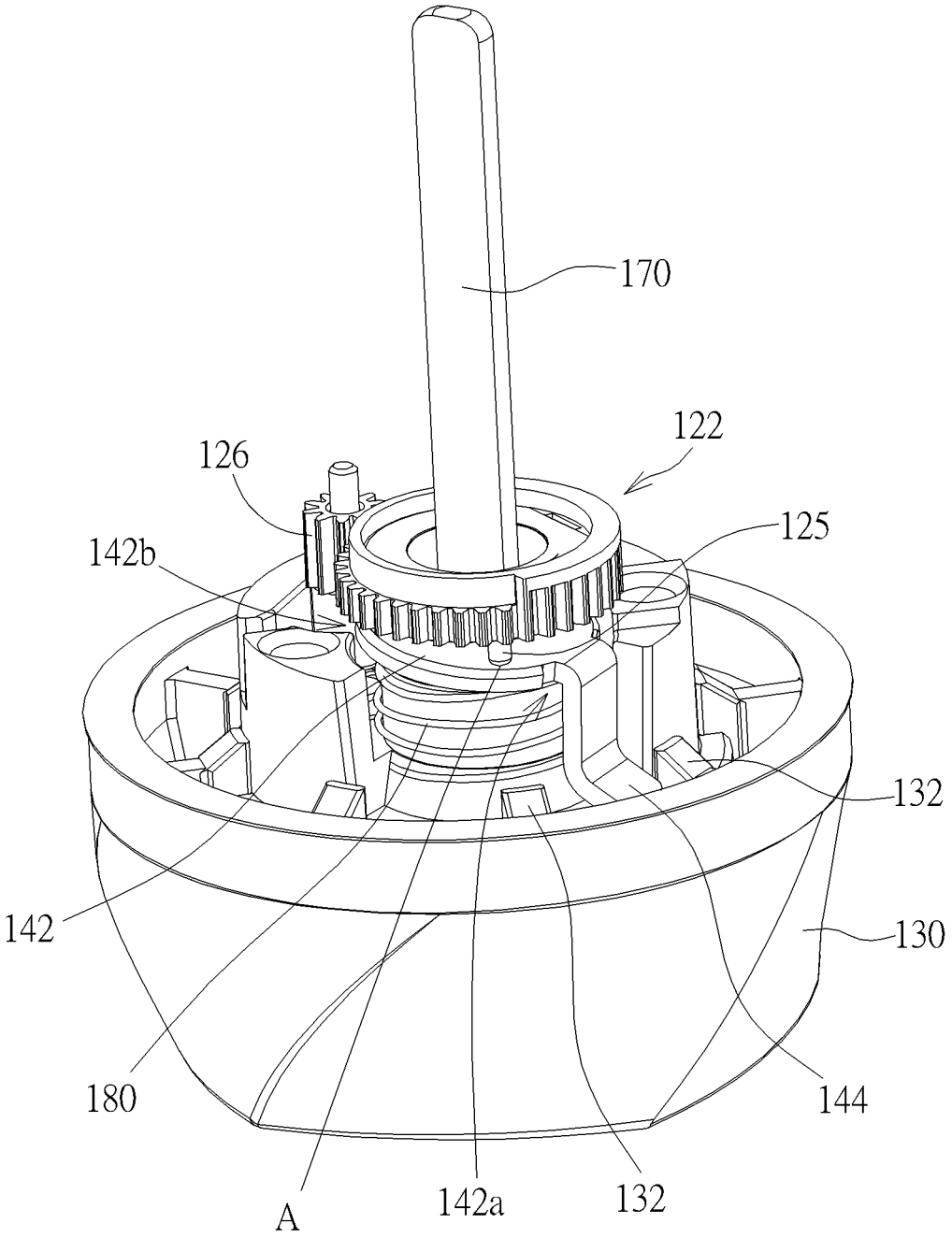
FIG. 6 is a diagram showing the electric lock of the present invention in an unlocked state.
Figure 7:
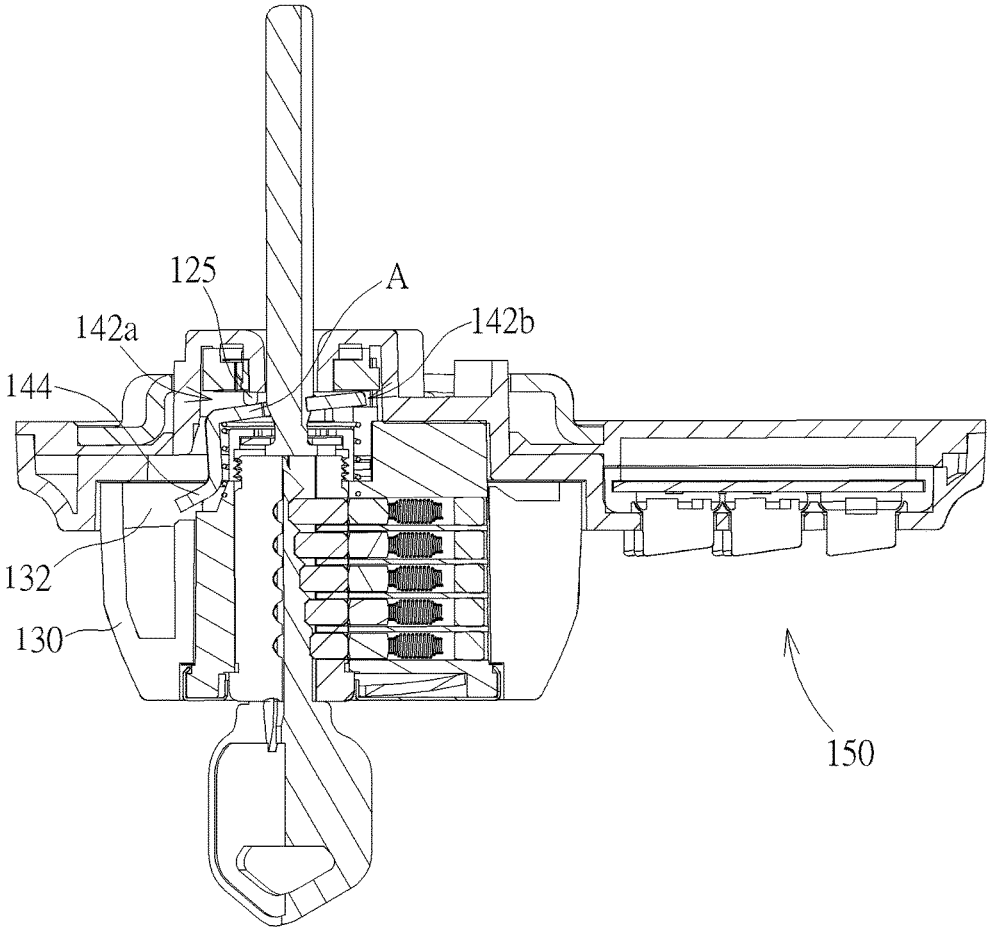
FIG. 7 is a cross-sectional view of the electric lock of the present invention in the unlocked state.

Please refer to FIG. 6 and FIG. 7 together. FIG. 6 is a diagram showing the electric lock of the present invention in an unlocked state. FIG. 7 is a cross-sectional view of the electric lock of the present invention in the unlocked state. As shown in figures, when the user controls the electric lock 100 to perform the unlocking operation via the input interface 150 (for example, a set of input data matches a set of predetermined unlocking data), the control unit 160 is configured to control the motor 124 to rotate, in order to further drive the driving member 122 to rotate, such that the pin 125 of the driving member 122 is moved to abut against the main body 142 at a first position A. When the pin 125 of the driving member 122 abuts against the main body 142 at the first position A, the first end 142*a* of the main body 142 is tilted toward the handle 130 (the second end 142*b* of the main body 142 is tilted away from the handle 130 accordingly), and the pushed structure 144 of the clutch member 140 is moved closer to the handle 130 to be located between the two pushing structures 132 of the handle 130. In other words, the pushed structure 144 is located in the groove. As such, when the user turns the handle 130, the pushing structure 132 is configured to abut against the pushed structure 144 to further drive the clutch member 140 to rotate. Accordingly, the transmission rod 170 is driven to move the latch from the locked position to the unlocked position.

On the other hand, when the first end 142*a* of the main body 142 is tilted toward the handle 130 and the pushed structure 144 of the clutch member 140 is moved to abut against a top end of the pushing structure 132 of the handle 130 without being located between the two pushed structures 132, the pin 125 of the driving member 122 is pushed by the main body 142 of the clutch member 140 to be retracted toward the second side 123*b* of the gear 123. As such, interference between the driving member 122 and the clutch member 140 can be avoided, that is, the transmission member 126 and the gear 123 can be prevented from being stuck. When the user further rotates the handle 130, the pushed structure 144 of the clutch member 140 no longer abuts against the top end of the pushing structure 132 of the handle 130, such that the pin 125 of the driving member 122 is protruded again from the first side 123*a* of the gear 123 to abut against the main body 142 at the first position A, so as to allow the pushed structure 144 of the clutch member 140 to be located between the two pushed structures 132. As such, the user can turns the handle 130 to drive the latch to move from the locked position to the unlocked position via the clutch member 140 and the transmission rod 170.

Figure 8:
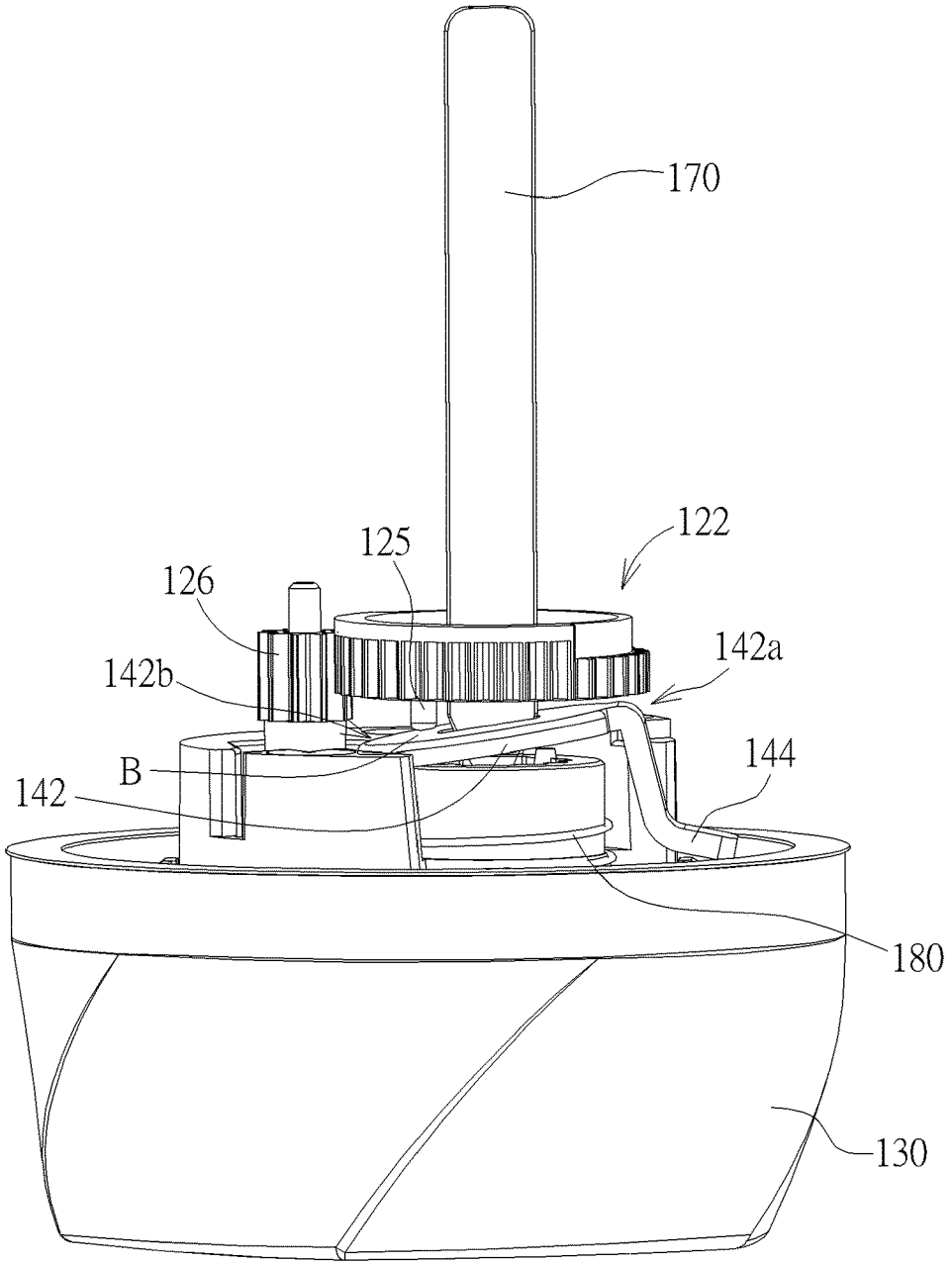
FIG. 8 is a diagram showing the electric lock of the present invention in a locked state.
Figure 9:
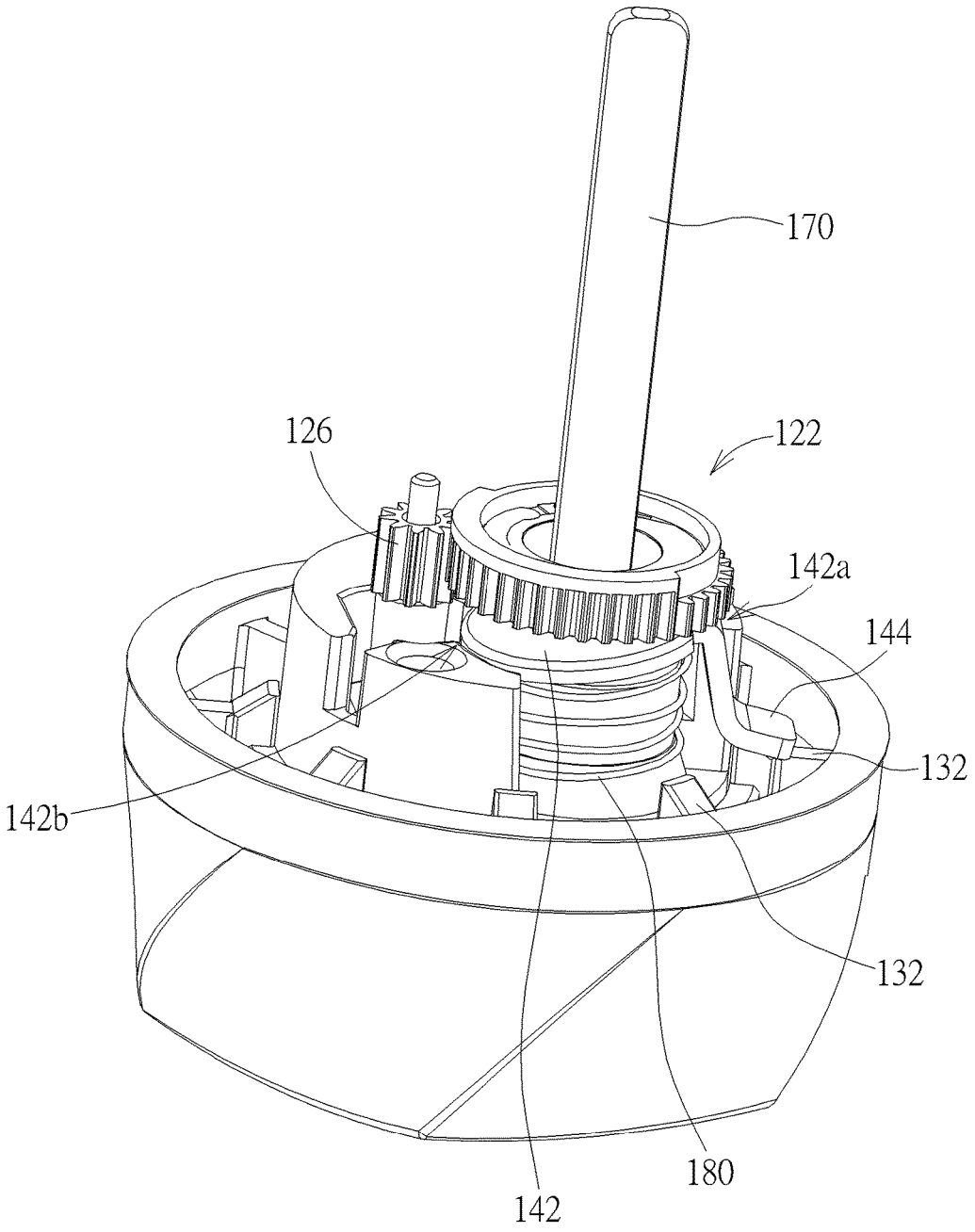
FIG. 9 is a diagram showing the electric lock of FIG. 8 in another angle.
Figure 10:
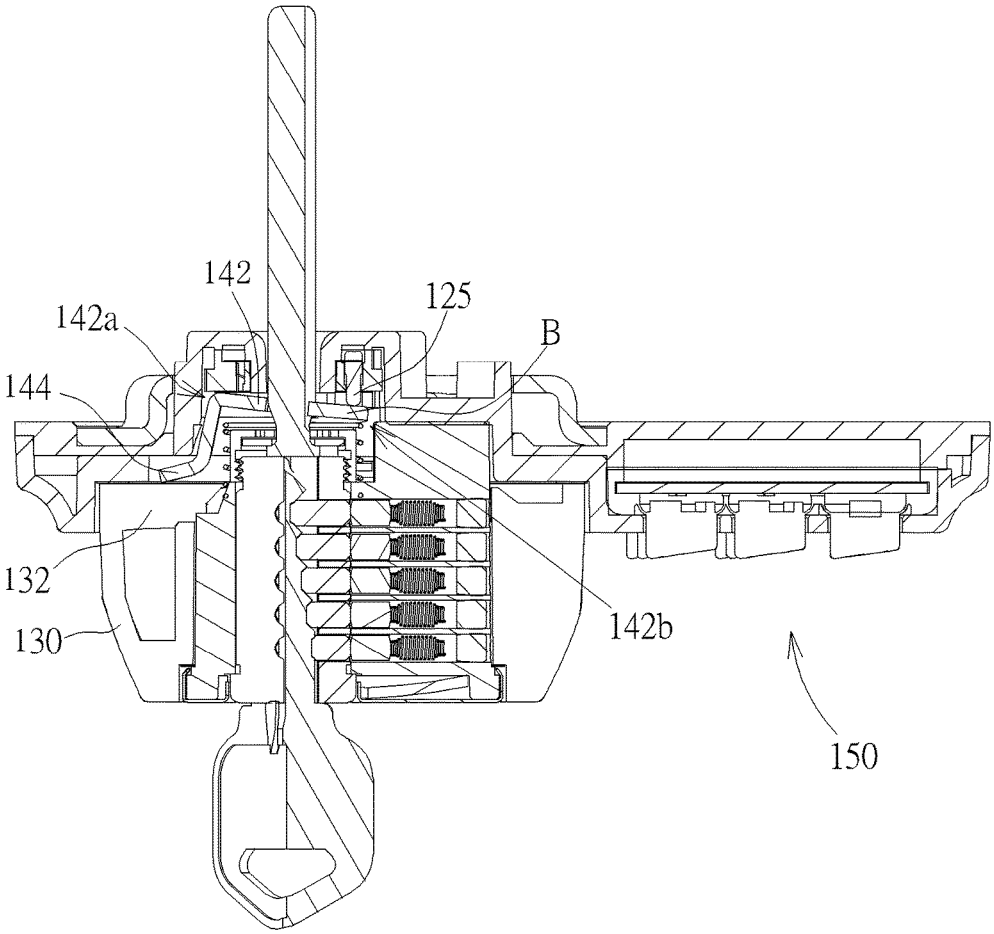
FIG. 10 is a cross-sectional view of the electric lock of the present invention in the locked state.

Please refer to FIG. 8 to FIG. 10. FIG. 8 is a diagram showing the electric lock of the present invention in a locked state. FIG. 9 is a diagram showing the electric lock of FIG. 8 in another angle. FIG. 10 is a cross-sectional view of the electric lock of the present invention in the locked state. As shown in figures, when the user controls the electric lock 100 to perform the locking operation via the input interface 150 (for example, a set of input data matches a set of predetermined locking data), the control unit 160 is configured to control the motor 124 to rotate, in order to further drive the driving member 122 to rotate, such that the pin 125 of the driving member 122 is moved to abut against the main body 142 at a second position B. When the pin 125 of the driving member 122 abuts against the main body 142 at the second position B, the first end 142*a* of the main body 142 is tilted away from the handle 130 (the second end 142*b* of the main body 142 is tilted toward the handle 130 accordingly), and the pushed structure 144 of the clutch member 140 is moved away from the handle 130 without being located between the two pushing structures 132 of the handle 130 (the pushed structure is located outside the groove). As such, when the user turns the handle 130, the pushing structure 132 is not able to abut against the pushed structure 144 to drive the clutch member 140 to rotate (that is, the handle 130 is merely rotated without working). In other words, the transmission rod 170 is not driven by the clutch member 140 to move the latch from the locked position to the unlocked position.

On the other hand, when the electric lock 100 of the present invention is in the locked state and the user uses the key 200 to turn the lock core 190 to further drive the transmission rod 170 to rotate for performing the unlocking operation, a position of the driving member 122 is not changed even if the clutch member 140 is rotated by the transmission rod 170. Therefore, the electric lock 100 remains in the locked state when the clutch member 140 is returned to an initial position.

In contrast to the prior art, a clutch mechanism (the driving module and the clutch member) of the electric lock of the present invention uses the motor to drive the driving member to rotate, in order to move the pin of the driving member to abut against the clutch member at different positions, so as to drive the clutch member to tilt for controlling the electric lock to be in the locked state or the unlocked state. The clutch mechanism of the electric lock of the present invention is simple and easy to assemble. Therefore, the present invention can reduce production cost and improve production efficiency.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An electric lock, comprising:

a base;

a driving module arranged on the base, the driving module comprising:

a driving member rotatable relative to the base; and a motor configured to drive the driving member to rotate;

a handle rotatably mounted to the base, and having a plurality of pushing structures; and a clutch member, comprising:

a main body having a first end and a second end opposite to the first end; and a pushed structure formed on the first end of the main body;

wherein when the motor drives the driving member to rotate in order to abut against the main body at a first position adjacent to the first end, the driving member drives the first end of the main body to tilt toward the handle, such that the first end is closer to the handle than the second end, which enables the pushing structure to abut against the pushed structure for the clutch member to rotate when with the handle.

2. The electric lock of claim 1, wherein when the motor drives the driving member to rotate in order to abut against the main body at a second position, the first end of the main body is tilted away from the handle, such that the pushing structure does not abut against the pushed structure when the handle is rotated.

3. The electric lock of claim 1, wherein the driving member comprises:

a gear; and a pin protruded from the first side of the gear for abutting against the main body of the clutch member.

4. The electric lock of claim 3, wherein the driving member further comprises an elastic piece arranged at the second side of the gear, the pin is connected to the elastic piece and penetrates through the gear to protrude from the first side of the gear.

5. The electric lock of claim 1, wherein the driving module further comprises a transmission member connected between the motor and the driving member.

6. The electric lock of claim 1 further comprising a transmission rod configured to be connected to a latch, wherein the transmission rod is driven to move the latch when the clutch member is rotated.

7. The electric lock of claim 6, wherein the clutch member is sleeved on the transmission rod.

8. The electric lock of claim 6 further comprising a lock core connected to the transmission rod for being driven by a key to further drive the transmission rod to move the latch.

9. The electric lock of claim 1, further comprising:

an input interface configured to receive a set of input data; and a control unit electrically connected to the input interface and the motor for controlling the motor to rotate when the set of input data matches a set of predetermined data.

10. The electric lock of claim 1 further comprising an elastic member configured to push the main body of the clutch member away from the handle.

11. A clutch mechanism, comprising:

a clutch member, comprising:

a main body having a first end and a second end opposite to the first end; and a pushed structure formed on the first end of the main body; and a driving module configured to abut against the main body of the clutch member and rotatable relative to the main body;

wherein when the driving module abuts against the main body at a first position adjacent to the first end, the driving module drives the first end of the main body to tilt away from the driving module and the second end of the main body to tilt toward the driving module, such that the first end is farther away from the driving module than the second end.

12. The clutch mechanism of claim 11, wherein when the driving module abuts against the main body at a second position, the first end of the main body is tilted toward the driving module, and the second end of the main body is tilted away from the driving module.

13. The clutch mechanism of claim 11, wherein the driving module comprises:

a driving member configured to abut against the main body of the clutch member; and a motor configured to drive the driving member to rotate.

14. The clutch mechanism of claim 13, wherein the driving module further comprises a transmission member connected between the motor and the driving member.

15. The clutch mechanism of claim 13, wherein the driving member comprises:

a gear; and a pin protruded from the first side of the gear for abutting against the main body of the clutch member.

16. The clutch mechanism of claim 15, wherein the driving member further comprises an elastic piece arranged at the second side of the gear, the pin is connected to the elastic piece and penetrates through the gear to protrude from the first side of the gear.

* * * * *